US005865928A

United States Patent [19]

Lariviere, Jr. et al.

[11] Patent Number: 5,865,928

[45] Date of Patent: Feb. 2, 1999

[54] PHOTOGRAPHS AND OTHER GRAPHIC MATERIALS CUSTOM CUT INTO INTERLOCKING PUZZLE SHAPES TO CONSTRUCT A COLLAGE- PUZZLE

[76] Inventors: Richard L. Lariviere, Jr.; D. Marie Lariviere, both of 17 Jay's La., Hanover, Mass. 02339

[21] Appl. No.: 905,989

[22] Filed: Aug. 5, 1997

Related U.S. Application Data

[60] Provisional application No. 60/023,766 Aug. 8, 1996.

[51] Int. Cl. [6] ..... B32B 31/00

[52] U.S. Cl. ..... 156/256; 156/62; 156/63; 156/263; 156/267; 428/33; 428/39

[58] Field of Search ..... 156/62, 63, 256, 156/263, 267; 428/33, 39

[56] References Cited

U.S. PATENT DOCUMENTS

| | | | |
|---|---|---|---|
| 2,586,039 | 2/1952 | Heggedal | 428/39 |
| 3,364,598 | 1/1968 | Cook | 428/39 |
| 3,574,017 | 4/1971 | Kass | 156/63 |
| 4,586,714 | 5/1986 | Lenkoff et al. | 156/62 |

*Primary Examiner*—David A. Simmons
*Assistant Examiner*—Robert R. Koehler
*Attorney, Agent, or Firm*—Pandiscio & Pandiscio

[57] ABSTRACT

A novel method of manufacturing collage puzzle pieces comprising the steps of: (a) providing a template in sheet form having a plurality of channels in the form of line perforations so as to define a plurality of puzzle pieces patterns, the channels being interrupted at selected locations so that at least one portion of each puzzle piece pattern is connected to at least one adjacent puzzle piece pattern; (b) mounting at least one selected graphic art object on an adhesive-coated substrate so as to form a workpiece; (c) assembling the workpiece and the template so that the template overlies the at least one graphic art object; (d) drawing a cutting blade along the full length of each channel defining a selected puzzle piece pattern so as to cut the underlying workpiece along lines conforming to the shape and location of the selected puzzle piece pattern, whereby to form a connected puzzle piece in the workpiece; (e) separating the template from the workpiece; (f) severing the connected puzzle piece from the workpiece; and (g) repeating steps (a) to (f) using the same template but workpieces that comprise different graphic arts objects, with each repetition of step (d) involving a different selected puzzle piece pattern, whereby a plurality of different puzzle pieces are formed. These puzzle pieces are combined to form a collage puzzle.

20 Claims, 10 Drawing Sheets

PHOTOGRAPHS AND OTHER GRAPHIC MATERIALS CUSTOM CUT INTO INTERLOCKING PUZZLE SHAPES TO CONSTRUCT A COLLAGE- PUZZLE

PRIOR APPLICATIONS

This is a continuation of and claims priority from U.S. Provisional application Ser. No. 60/023,766, filed Aug. 8, 1996 by Richard L. Lariviere, Jr. and D. Marie Lariviere.

FIELD OF INVENTION

The present invention relates to puzzles and more particularly to methods and apparatus for making individualized custom collages from a variety of interlocking pieces made from photographs and other graphic materials and assembled as a puzzle. In essence, a puzzle collage.

BACKGROUND OF INVENTION

The making of collages is well known and involves the random placement of irregular shaped cut-outs of pictures, photographs, news headings and other graphic materials to create a "theme or story-board." The cut-outs are almost always handmade and without much regard for their individual shapes. These pieces are usually abutted to each other or are assembled together with irregular gaps between each piece. Modern day collages have advanced somewhat in sophistication through an expansion in available mediums and have become a largely recognized art form. However, the basic concept of construction with odd shaped ill fitting pieces to construct a "story board or theme" has not changed.

Puzzles differ from collages in that they are routinely constructed of precisely cut interlocking pieces that, when assembled, form a complete autogenous picture. Puzzles are generally constructed by stamping a single picture with a steel-rule die or using a continuous cutting saw, such as a jigsaw, to create varying numbers of interlocking puzzle pieces. Hand cutting of individual puzzle pieces is generally not employed, since it is more efficient to utilize die cutting or continuous cutting where the cutting motions that create the individual pieces simultaneously form the surrounding pieces, thus ensuring an exacting fit of the pieces. Only through creating the individual pieces with common separation lines to the surrounding pieces has it been possible to create the exacting shapes necessary to form interlocking pieces with enough circumferential intimacy so as not to detract from the quality of the picture when the puzzle is fully assembled.

More recent advances have resulted in the creation of intricate three dimensional puzzles (see U.S. Pat. No. 5,178,391 entitled "Three-Dimensional Jigsaw Puzzle") where the puzzle pieces when assembled form a three dimensional structure. Another advancement in the diversification of puzzles, as described in U.S. Pat. No. 5,158,295 entitled "Picture Puzzle Assembly", incorporates the use of a magnetic backing to allow the puzzle to be magnetically adhered to surfaces. However, as with conventional puzzles, these puzzles are made by die cutting or continuous saw-cutting the puzzle pieces from a single picture.

Hand-cutting of puzzle-shaped interlocking pieces from photographs and other graphic materials is currently possible through the use of scissors and other sharp cutting instruments by first drawing or tracing around a pre-existing puzzle piece. However, the accuracy of these methods is limited by the errors introduced during the sketching or transfer of the shape via tracing. The inaccuracies are further compounded by the errors introduced in attempting to cut the drawn or traced outline with scissors or other sharp instruments. Similarly, attempting to form an exact duplicate by cutting a photograph or other graphic material while it is firmly held against an existing puzzle piece is flawed, as clearances and allowances must be made for the thickness of the scissors blades or other sharp cutting surface while they cut against the edge of the puzzle piece. Again, this approach results in an ill-conforming finished part.

OBJECTS OF THE INVENTION

The primary object of this invention is to create puzzle pieces from a multitude of graphic arts objects to form a theme or story board, which is hereby termed a "collage puzzle".

A further important object of this invention is to utilize a variety of individual pictures and or other graphic arts materials to form a collage comprising a plurality of individual puzzle pieces having the same exacting fit as the individual interlocking pieces of conventional commercially available puzzles.

Another important object of this invention is to provide a method and device which involves and facilitates precision fabrication of a plurality of interlocking pieces from individual photographs and other graphic arts materials, with those pieces when assembled combining to form a theme or story board collage.

Still another object of the present invention to provide a method of fabricating a custom, handmade puzzle from individual photographs and other graphic materials.

A further object of the present invention is to provide a new method of making collages.

BRIEF DESCRIPTION OF THE PRESENT INVENTION

As used herein, the term "graphic arts object" is intended to embrace all 2-dimensional image-presenting materials, including but not limited to photographs, drawings, sketches, diagrams and the like, including fax copies thereof. However, it is contemplated that the image-presenting materials may have 3-dimensional features that are captured or reproduced by the present invention.

This invention is designed to overcome (1) the individual shortfalls of a conventional collage's randomly-cut ill-fitting pieces used to create a "story or theme board" and (2) a conventional puzzle's dependency on being constructed out of a single picture by cutting each piece with shared boundaries to the surrounding pieces to attain the precision fit of the interlocking pieces.

More specifically the present invention provides a method and means for an individual to fabricate a custom collage-puzzle from graphic arts objects. While photographs are the preferred items for forming collages, the invention is applicable equally well to other forms of graphic arts objects, e.g., picture cutouts from magazines, alpha numeric arrays presenting selected messages such as "Happy Birthday", sketches of deceased or live persons, etc.

The invention involves use of see-through (transparent or translucent) templates, a knife (preferably of the swivel blade or rotary wheel-type blade for a particular aspect of the method of the invention), and an adhesive coated substrate. The templates are pre-cut to exacting dimensions and shapes to afford the user the opportunity to fabricate a variety of custom collage-puzzle shapes. Each template is formed with a plurality of through cuts that form channels which are interrupted or separated from one another so as to define the outlines of a plurality of puzzle pieces that are interconnected by webs so as to prevent the puzzle pieces from separating from the template. The widths of the channels are precisely established according to the thickness dimension and geometry of the knife blade so as to limit side to side movement of the knife blade, whereby to assure that the cuts made by the knife blade are exact and reproducible. With respect to use of a swivel knife blade or a rotary wheel knife blade, the linear patterns of the channels are configured to accommodate the turning ability of the knife blade, allowing the blade to advance freely without compromise to the overall conformance of the piece being cut. Utilizing this method and aligning individual photographs or other graphic arts objects under the template and within the puzzle pattern outlines created by the channels, individual puzzle pieces can be cut from various photographs or other graphic arts materials. For each template, this process is repeated until each of the puzzle piece outlines provided on the template has been cut out of selected (different or the same) graphic arts objects, whereupon the individually cut-out puzzle pieces can be assembled together to form an interlocking collage assembly limited in size, shape and complexity only by the configuration of the template.

Making the template of a clear, transparent material is beneficial since it facilitates orientation and cutting of the individual photographs or other graphic arts objects or materials. A clear translucent template also may be used, providing the template transmits enough light to enable the user to see the desired features of the photograph or other graphic arts object (the "selected image") and also to precisely position the selected image within the outline of a selected puzzle piece of the template in preparation for cutting a pattern of that selected puzzle piece into that portion of the graphic arts object that includes the selected image, and also for aligning the template and the graphic arts object.

As an optional measure to aid in restraining the photographs or other graphic materials during cutting, the template is provided with perforations (holes) sized to accommodate push-type pins for attaching a workpiece (consisting of the graphic arts object and the underlying substrate) to an underlying cutting mat or board, so as to render the workpiece stationary during a subsequent cutting operation. The pin-receiving holes in the template may be located around the periphery of the desired image graphics arts object, e.g., a 4"×6" photograph, and preferably are placed through portions of the graphic arts object that are not to be used to form a collage puzzle piece.

Preferably the invention is practiced using a swivel or rotary knife to reproduce the template outline of a selected puzzle piece in a workpiece. As used herein, the term "rotary knife" is intended to denote a knife that comprises a circular cutting blade that is rotatably mounted o a handle or other support, e.g, a rotary knife similar to those used to cut pizzas. The knife is used to cut a photograph and/or some other graphic arts object along lines corresponding to the channels in the template that form the outline of the selected puzzle piece. Preferably the swivel or rotary knife blade is designed and dimensioned to permit it to fit into and follow the configurations of the channels in the template. More specifically, it is preferred that the width of the knife blade be selected so that it is only slightly less than the width of the channels in the template, whereby side-to-side movement of the knife blade in the channels is limited so that the shape of each piece being cut conforms substantially exactly with the outline of that piece in the template. This assures that the cutting out of each puzzle piece is reproducible. Preferably the knife blade is configured to readily accommodate and follow changes in the radii along the length of the channels in the template, allowing the blade to advance freely without compromise to the overall conformance of the puzzle piece being cut. The cutting depth of the knife blade is at least great enough to allow it to penetrate the thicknesses of (1) the template, (2) the photograph or other graphic arts object, and (3) the adhesive-coated substrate, so as to ensure that each selected puzzle piece outline in the template is reproduced in the workpiece.

Preferably but not necessarily, practice of the present invention may include use of a straight knife to complete the final cutting operation required to separate a selected puzzle piece from the workpiece. As an alternative measure, the swivel knife employed in the first cutting operation for manufacturing a selected puzzle piece may also be used for the second (final) cutting operation involved in manufacturing the same selected puzzle piece. In this connection it should be noted that the channels of the templates form the majority of the outline of the individual puzzle pieces. The small interruptions of the channels which prevent the puzzle piece portions of the template from separating from the template also serve to help prevent cutting out the complete outline of the puzzle piece during the initial cutting operation. In essence these small interruptions of the channels forming the puzzle piece outlines create small remaining connections (webs) for the individual puzzle piece portions of the workpiece after the initial cutting operation. The straight knife is utilized to cut through these remaining connections, completing the outline of the individual puzzles piece and thereby separating that piece from the workpiece.

As noted above, the invention also utilizes an adhesive coated substrate to which a related graphic arts object may be adhered directly prior to cutting. The adhesive layer of the substrate is pressure sensitive and bonds to the back of the graphic arts object, firmly affixing the graphic arts object to the substrate. The substrate is designed to provide depth and rigidity to the individually cut puzzle pieces, thereby facilitating interlocking of such individual puzzle pieces to form a complete collage puzzle. The laminated assembly can then be cut as described above to exacting precision, creating not only a line-to-line fit but also a three dimensional fit of each of the puzzle pieces.

As an optional measure and added benefit, the adhesive coating on the substrate can also aid in securing the laminate to the template for the initial cutting operation. This is accomplished by leaving a small amount of adhesive coating on the substrate exposed around one or more of the outer edges of the photograph or other graphic art object, whereby the adhesive can be engaged with the template to prevent lateral movement of the laminated assembly relative to the template during the cutting operation.

As a further optional measure, the substrate may be coated with an adhesive layer on both sides. In such event, the individual cut pieces of the graphic arts objects can not only be adhered to the adhesive-coated substrate, but they can also be firmly mounted to a selected backing member for display or mounting purposes.

BRIEF DESCRIPTION OF THE DRAWINGS

Like numerals in the several figures are intended to identify like components or elements.

DETAILED DESCRIPTION OF THE PRESENT INVENTION

Figure 1:
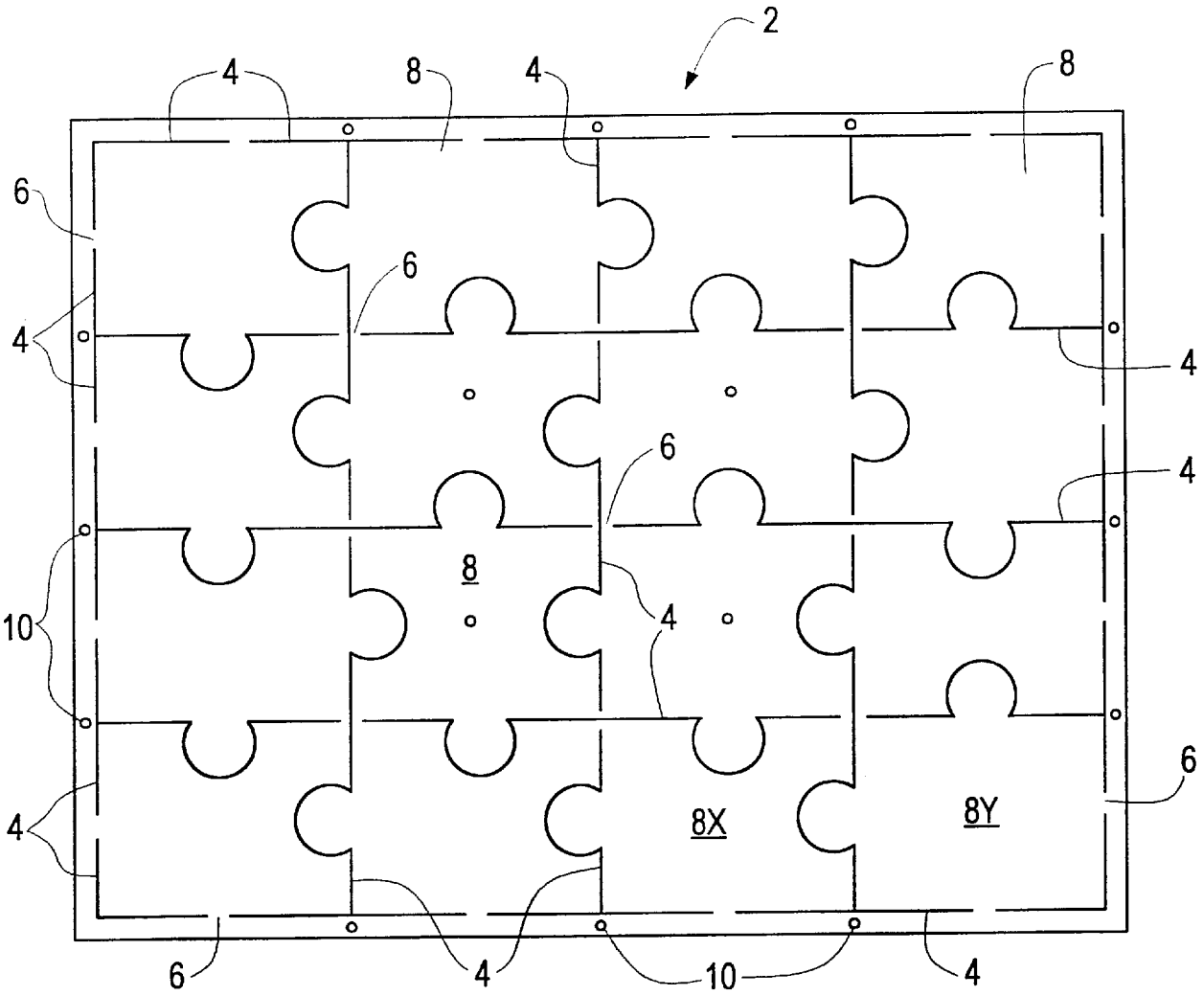
FIG. 1 is a plan view of a selected rectangular template illustrating a puzzle configuration for a plurality of individual pieces.

Referring to FIG. 1, there is shown a template 2 for making puzzle pieces in accordance with this invention. The puzzle pieces presented by the template can vary in size and shape. Template 2 is fabricated from a clear transparent or translucent material. A transparent template is preferred to facilitate viewing and aligning desired portions of the photographs or other graphic arts objects prior to cutting the latter. Since it is intended that they be reusable, the templates are preferably made of a material that resists wear, e.g., a polycarbonate or polyacrylate material. Preferably, the templates are stiff to facilitate use thereof.

Figure 2:
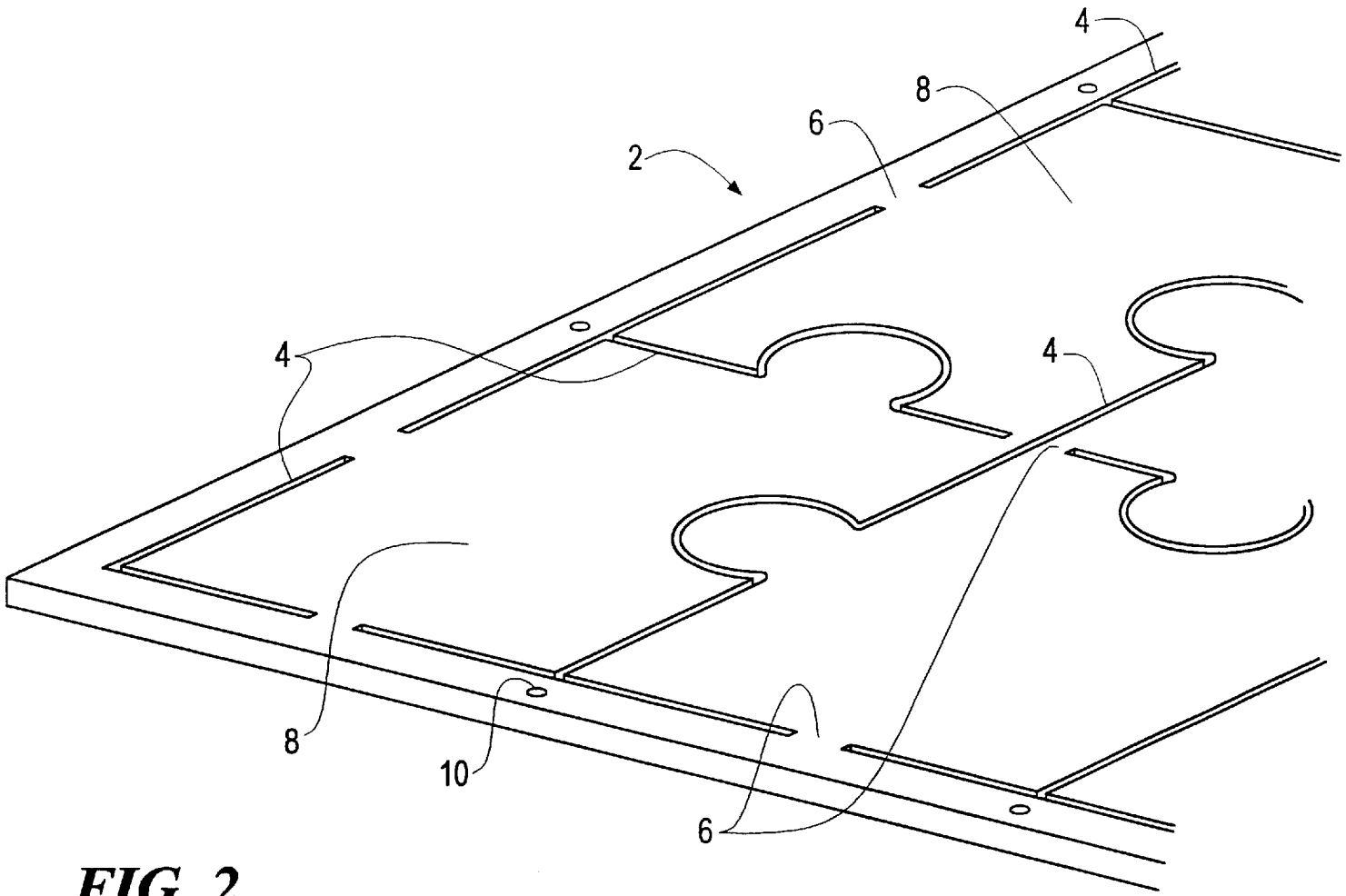
FIG. 2 is an enlarged fragmentary perspective view of a template illustrating the channels, channel interruptions and locator holes.

Referring now to FIGS. 1 and 2, the template comprises a plurality of channels in the form of through cuts 4. These channels define the outlines or patterns of individual puzzle pieces and are formed with identical widths of exacting precision to accommodate a thin knife blade and ensure that the patterns will be reproduced with precision in the workpiece. Preferably the channels have a width in the range of 0.015 inch to 0.017 inch to accommodate a knife blade having a thickness of 0.011 inch to 0.013 inch. Small interruptions of the channels 4 are provided to form web portions 6 that maintain the integrity of the template and prevent individual puzzle piece-defining portions 8 from separating from the template. The interruptions in the channels 4 are sized to minimize the amount of material which has to be cut without the aid of the template, but the webs 6 are sufficiently large to maintain the overall integrity of the template. As an additional optional measure, the template may be provided with push-pin holes 10 to accommodate push-pins to hold the template in place during pattern cutting.

Figure 3:
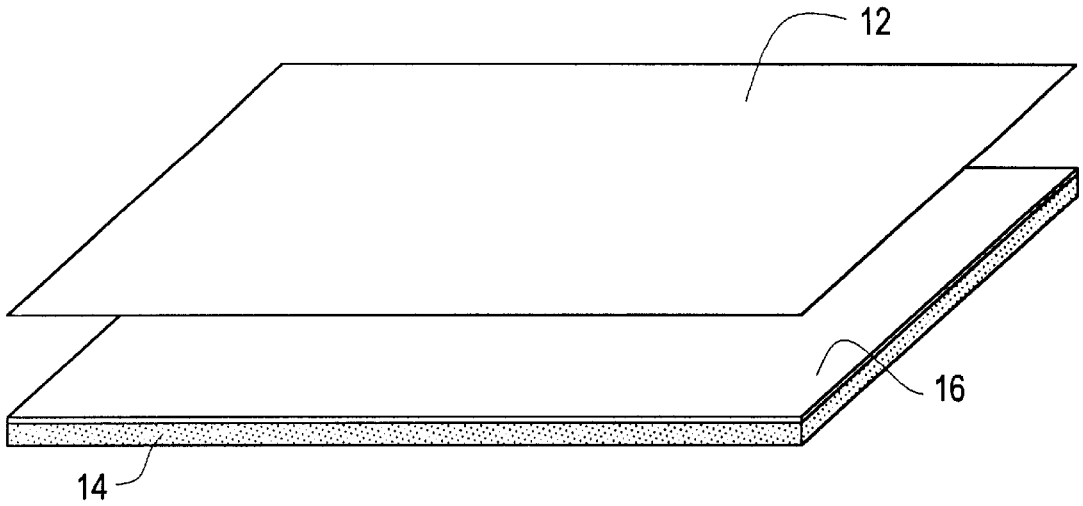
FIG. 3 is an exploded view of a photograph or other graphic material in confronting relation to the adhesive side of a substrate.
Figure 4:
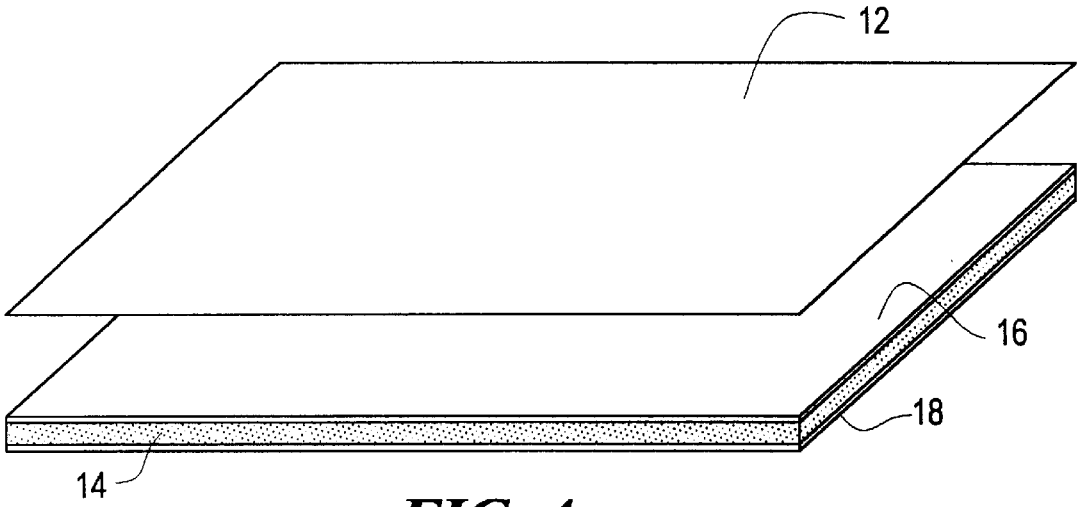
FIG. 4 is like FIG. 3 but differs in that the substrate has an adhesive coating on both sides thereof.

Referring now to FIGS. 3 and 4, a selected graphic arts object 12, e.g., a drawing or photograph or other graphic arts material in sheet form, is provided together with a substrate 14 having a coating 16 of a pressure sensitive adhesive on one side thereof. Hereinafter the combination of a graphic arts object 12 attached to an adhesive coated substrate 14 is sometimes identified as the "workpiece". As used herein the term "graphic arts object" comprises graphic materials, including photographs, drawings, sketches, printed or hand-drawn alpha or numeric text, and other like image-presenting materials.

The substrate is made of a material that is in sheet form, has sufficient thickness to render the resulting puzzle piece capable of interlocking with another puzzle piece, yet can be hand cut with a knife or razor blade. The substrate may be stiff or flexible, but if flexible it should be capable of laying flat without need to anchor it to prevent it from curling up on itself. Preferably, it is a low density material so as to facilitate its being cut by a hand-operated knife or razor blade. A preferred substrate is a sheet of a low density polyethylene foam. Another usable substrate material is sheet of an extruded low density polystyrene. Still other equivalent substrate materials will be obvious to persons skilled in the art. Preferably the substrate has a thickness of 0.050 inch to 0.10 inch, although thinner or thicker substrates, e.g., substrates with a thickness of 0.20 inch, also may be used, depending on the intended market. Although not shown, it is preferred that in its as-supplied form the substrate 14 includes a silicone release sheet (not shown) overlying the adhesive coating 16, so as to protect the adhesive layer until it is time to mate the substrate with a photograph or other graphic arts object.

Referring now to FIG. 4, as an alternative measure, the substrate can have its opposite side coated with another adhesive coating 18 for use in permanently affixing the assembled (finished) collage puzzle to a suitable support (not shown) for display or framing and mounting purposes. By way of example, the support for the collage puzzle may be a cardboard sheet or a sheet of stiff particle board.

It is to be understood that the substrate material 14 can vary in consistency and size to provide for a variety of looks and uses. Substrates having uneven or inconsistent thicknesses can create a three dimensional look for the assembled collage-puzzle.

It also is contemplated that the substrate can be a magnetic material, e.g., a foam plastic sheet material that is loaded with magnetic particles to render it magnetic. By way of example, the magnetic substrate may comprise a polyethylene foam having a thickness in the range of 0.010 inch to 0.20 inch, preferably a thickness of 0.010 inch. Such a substrate could permit the assembled collage puzzle, or only selected puzzle pieces, to be releasably mounted to a metal surface such as a refrigerator door.

Figure 6:
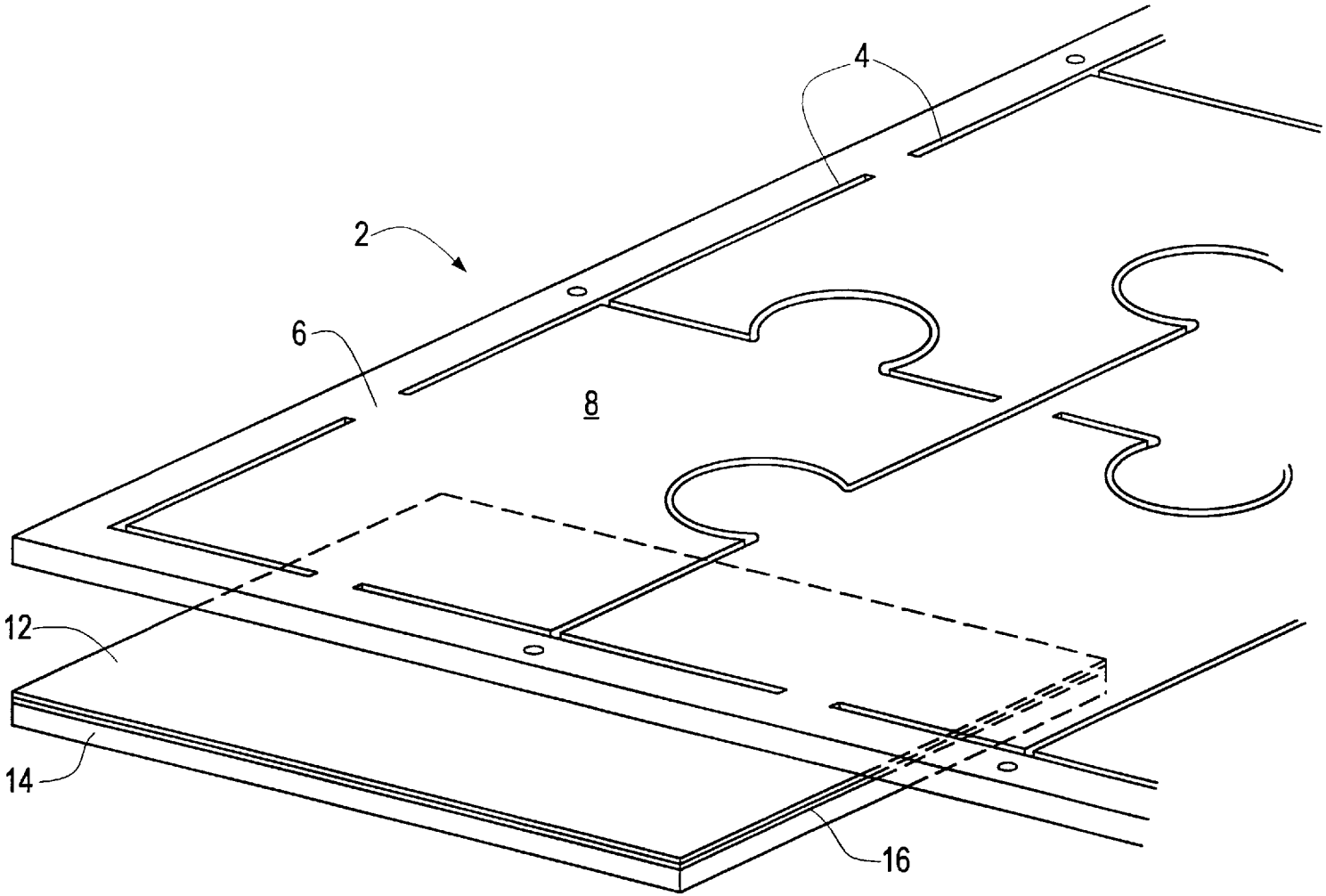
FIG. 6 shows a typical workpiece according to this invention, the workpiece comprising an adhesive coated substrate and a photograph or other graphic arts material adhered thereto, in exploded relation with a clear template.

FIGS. 6, 7, and 9–11 illustrate the preferred method and apparatus for practicing the invention. FIG. 6 illustrates the first and second steps in the method of this invention. The first step comprises assembling a selected workpiece consisting of a graphic arts object 12 adhesively attached to a selected adhesive-coated substrate 14. By way of example and for the sake of better understanding the invention, assume that the graphic arts object is a photograph of one or more persons. The second step comprises providing a selected transparent template 2 as described above. The clarity of the template enables viewing and proper alignment of the desired features of the photograph component of the workpiece. The third step is aligning and engaging the template with the workpiece. In this preferred form of practicing the invention, the adhesive-coated substrate is sized so that one or more of its peripheral edges protrude beyond the edges of the selected graphic arts object, whereby the adhesive coating on the protruding edges of the substrate are engaged by the peripheral portions of the template, thereby causing the template to be affixed to the workpiece (or vice versa) prior to any cutting operation. For convenience of illustration, no effort is made in FIGS. 6 or 7 to show the extent to which the substrate extends beyond the margin of the graphic arts object.

Figure 7:
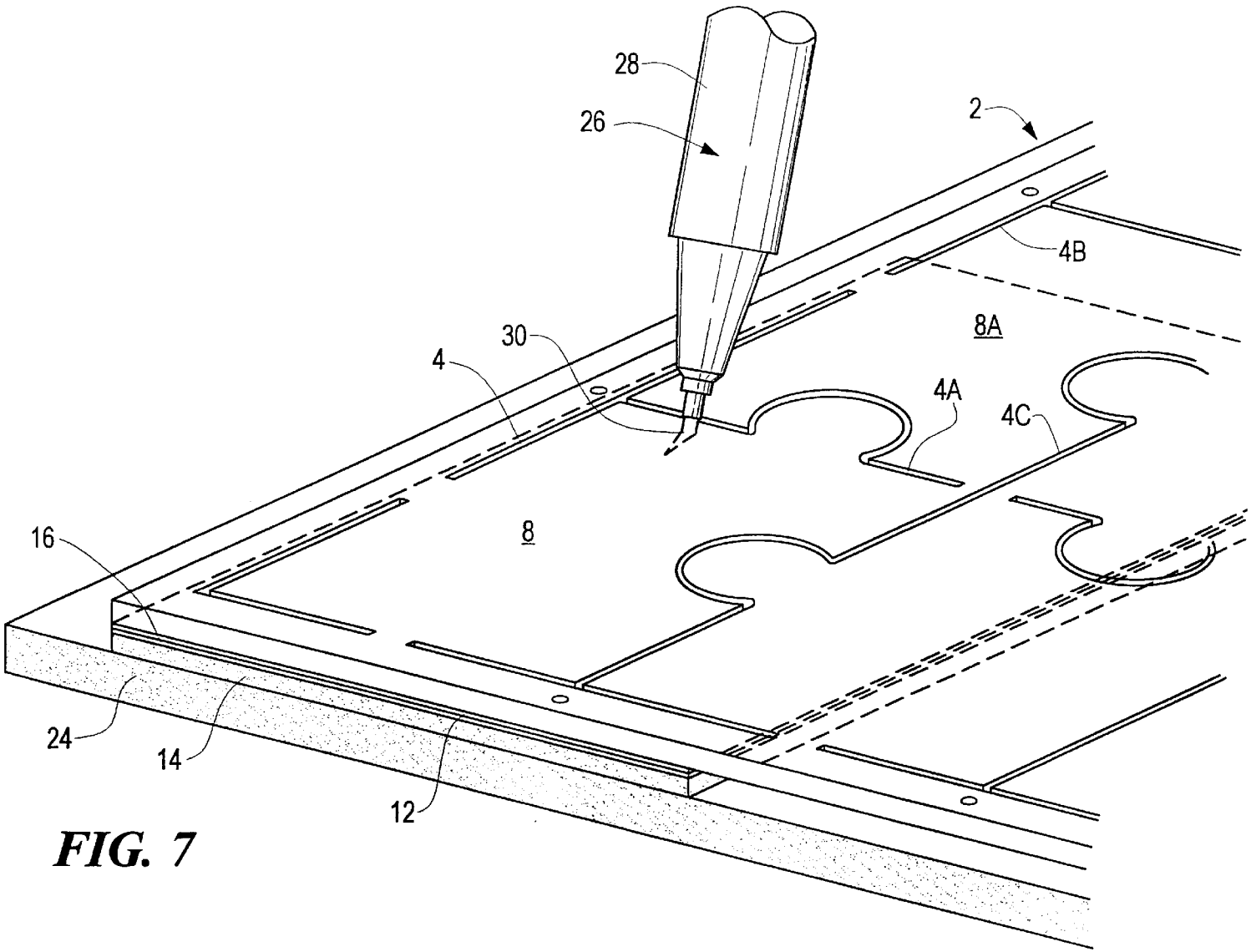
FIG. 7 shows a workpiece and template on a cutting mat, and illustrates the step of cutting a puzzle pattern out of the workpiece while the workpiece is being held to a template by means of excessive or misaligned adhesive on the substrate.

Referring further to FIG. 7, the fourth step is positioning the workpiece (12, 14) on a cutting mat or board 24 in a sandwich configuration. The cutting mat or board may take various forms, but preferably it is a stiff but compressible fibreboard sheet. As an alternative, the cutting board may be made of wood. Still other materials may be used as a cutting mat or board.

Figure 5:
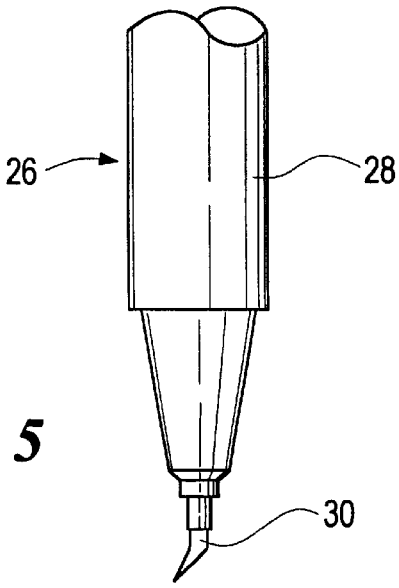
FIG. 5 is a side view in elevation of a swivel knife having a blade configured to be compatible with a template and a workpiece that comprises an adhesive-coated substrate and a graphic arts object.

Next, a swivel knife 26 of the type shown in FIG. 5 is used to reproduce a selected puzzle piece pattern or outline in the workpiece. As represented in FIG. 5, the swivel knife comprises a handle portion 28 and a knife blade 30 that is mounted to the handle portion so that it is capable of a swivel motion relative to the handle, i.e., the blade 30 can rotate on the axis of the handle of the knife. The blade 30 is sized and shaped so as to make a close fit with the precise and uniform widths of the channels 4, so as to limit side-to side motion of the knife blade in the channels and thereby ensure that the cutting accurately reproduces the selected puzzle piece pattern in the workpiece.

Still referring to FIG. 7, assume that the first collage puzzle piece to be produced is one conforming in shape to puzzle piece pattern 8A, the latter being defined or outlined by channels 4A–4C. The knife blade 30 is positioned in one of the channels, e.g., channel 4A, that defines the selected puzzle piece pattern 8A, so that the knife blade penetrates completely through the template and the workpiece. The knife blade is then drawn along the full length of that channel, thereby making a correspondingly shaped cut in the workpiece. Thereafter that cutting process is repeated for each of the two other channels 4B–4C that cooperate to define the selected puzzle piece pattern 8A. The knife blade 28 makes a clean cut through the workpiece.

Figure 10:
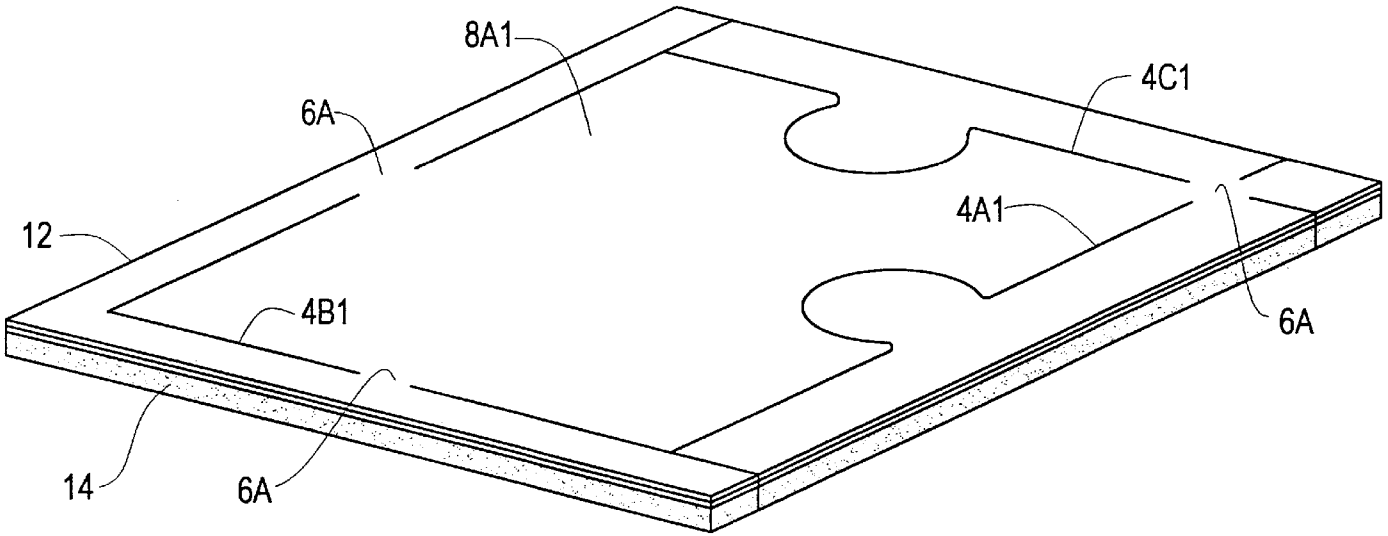
FIG. 10 shows a workpiece after completion of the initial cutting operation and subsequent removal of the template, and illustrates the small connections (webs) which remain in the workpiece after the initial cutting operation using the template.

Thereafter the template is removed, leaving the workpiece with cuts corresponding to channels 4A–4C that define an unsevered puzzle piece. FIG. 10 shows a portion of the workpiece 12, 14 with the pattern of the selected puzzle piece pattern 8A reproduced therein by use of the template and knife 26 as described. In FIG. 10 the cuts formed in the workpiece corresponding to channels 4A–4C are identified as 4A1 to 4C1 respectively, the unsevered puzzle piece is identified as 8A1, and the webs corresponding to webs 6 are identified as webs 6A.

Figure 9:
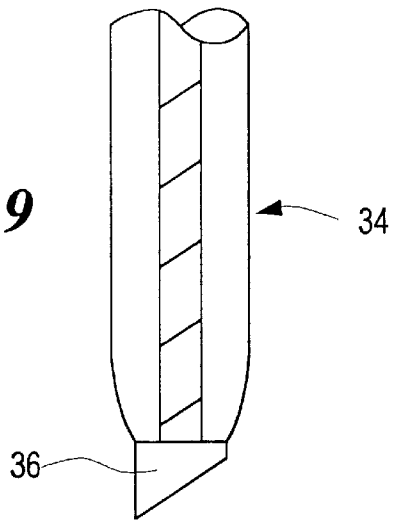
FIG. 9 is a side view in elevation of a straight edge hobby knife.
Figure 11:
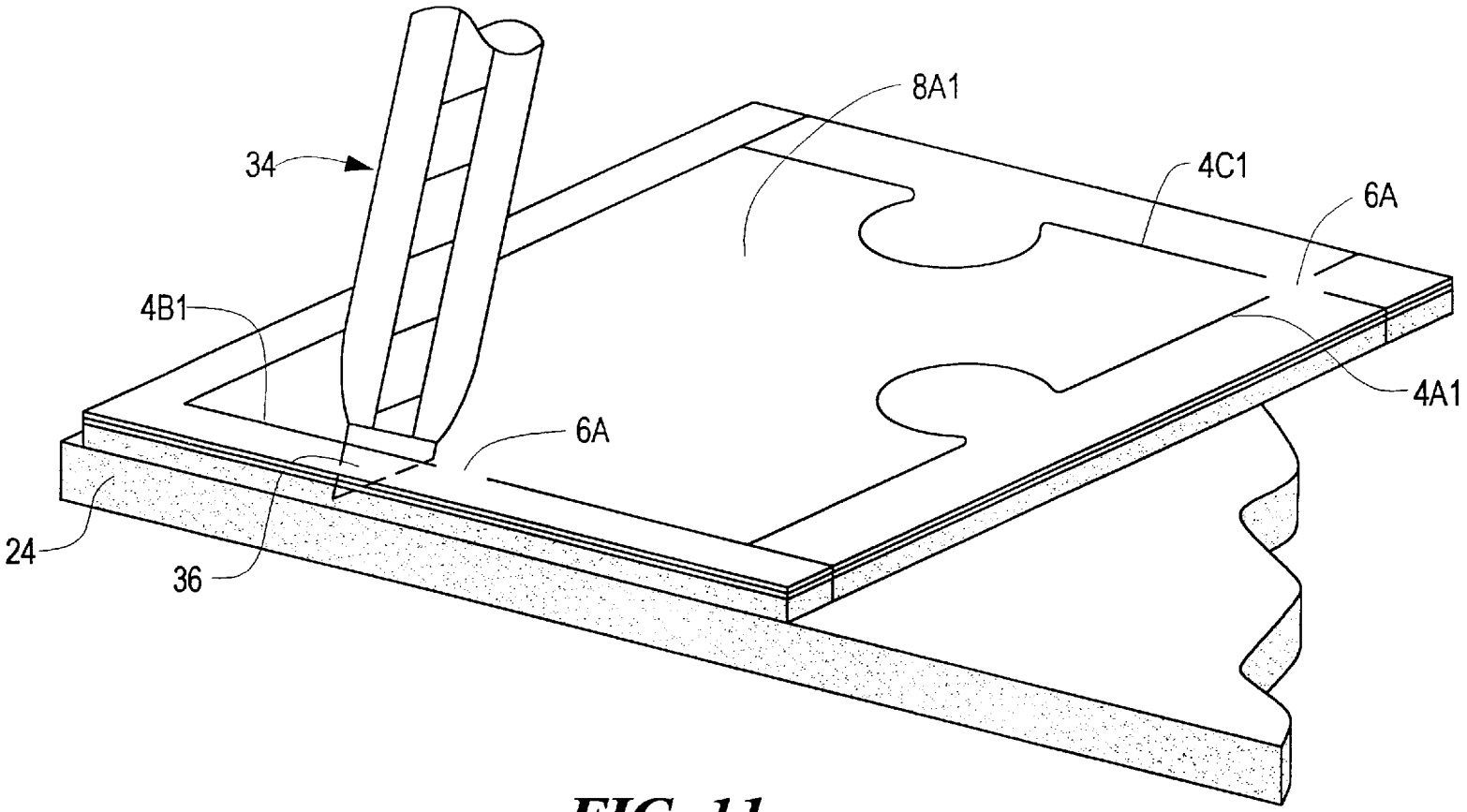
FIG. 11 shows the workpiece of FIG. 10 positioned on a cutting mat, and illustrates how a straight edge hobby knife is used to make the final cuts through the small connections (webs), whereby to complete manufacture of the puzzle piece.
Figure 12:
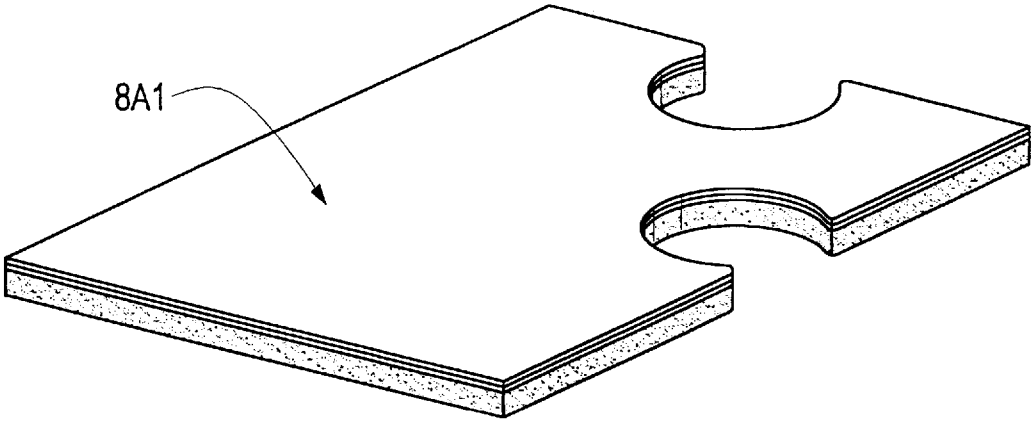
FIG. 12 shows a finished laminated puzzle piece, illustrating the individual layers which combine to provide rigidity and facilitate three dimensional interlocking of the finished puzzle pieces.

Next as shown in FIG. 11, the workpiece portion with the selected puzzle piece 8A1 is placed on a cutting mat or board 24 again and a straight edge hobby knife 34, as shown in FIG. 9, is used to sever the webs 6A, thereby freeing the piece 8A1 so that it appears as a discrete collage puzzle piece as shown in FIG. 12. Further with reference to FIG. 9, the straight edge hobby knife 34 has a blade 36 that is optimally shaped to make clean straight cuts through the webs 6A which remain in the workpiece after the latter has been cut using the template and the swivel or rotary knife.

Figure 13:
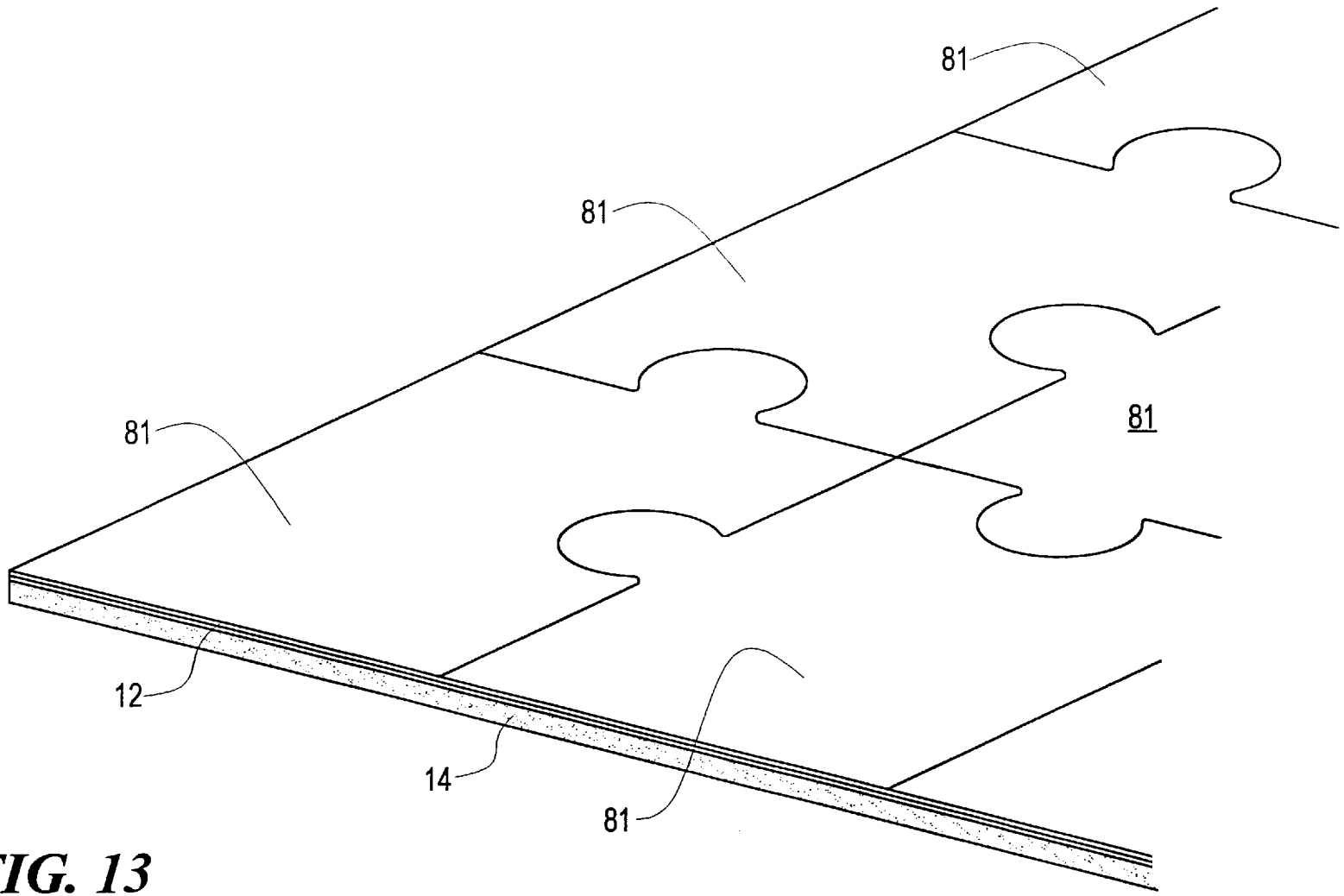
FIG. 13 is a fragmentary view illustrating a collage puzzle comprising puzzle pieces made in accordance with this invention.

The foregoing procedure is repeated using the same template 2 to cut other puzzle pieces from the same or different graphic arts objects, with each new puzzle piece conforming in shape to a different puzzle piece outline provided by the template. The result, as represented in FIG. 13 is a group of interlocking puzzle pieces 81 that can be assembled to form a collage puzzle, with each of the pieces 81 presenting a unique image. Thus, for example, each puzzle piece may comprise different photographic images of the same or different persons. Regardless of the images constituting the collage, the finished pieces 81 are intimately interlocked to form a neat collage-puzzle. The puzzle pieces 81 have shapes conforming to the different puzzle piece outlines defined in the template by the various channels 4. The puzzle piece outlines may have different or similar shapes and be of like or different sizes. The accuracy of the template and the knife cuts formed in each workpiece assures that the interlocked pieces will form a continuous pattern, without physical interruptions, with the thickness of the substrate assuring the desired interlocking of the pieces making it easy to frame or mount the final collage-puzzle.

Figure 8:
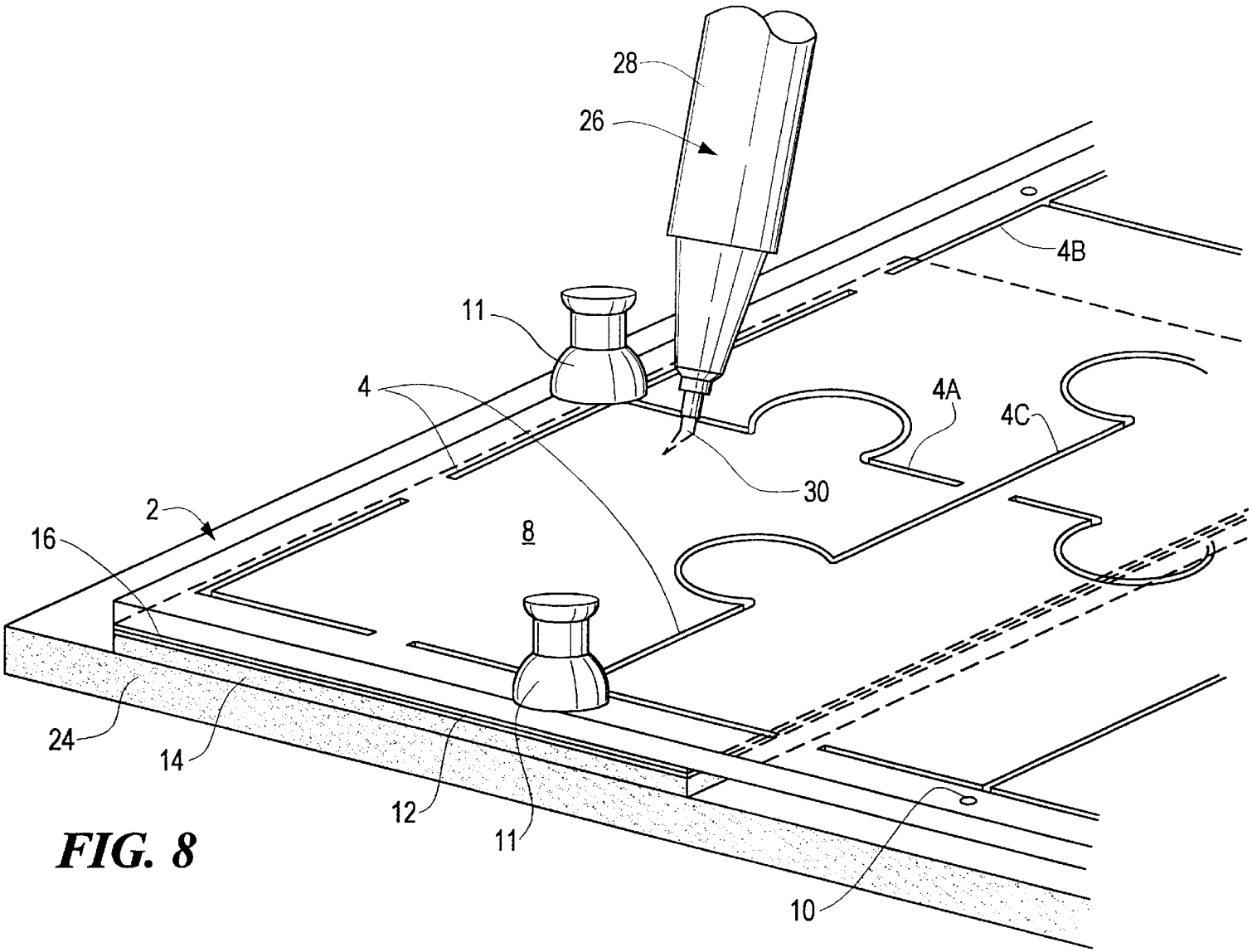
FIG. 8 is similar to FIG. 7 but differs in that the laminated workpiece consisting of a photograph or other graphic arts object and a supporting adhesive-coated substrate is temporarily attached to the template by push-pins.

FIG. 8 illustrates a modification of the invention. In this case, the template is temporarily attached to the workpiece by a plurality of push pins 11 that extend through holes 10 into the workpiece. Preferably the pins 10 are long enough so that they also penetrate the underlying cutting mat 24. The swivel knife 26 is used in this modification in the same manner as described above in connection with FIG. 7 to cut a desired puzzle piece into the workpiece.

It is to be noted that the invention does not require both a swivel knife and a straight edge knife as described above. Instead the swivel knife can be used to perform the cutting operation for which the straight edge knife is recommended. Also for many applications, both of the knives described above may be replaced by a simple razor blade.

The invention offers the advantages noted above and the further advantage that the template and adhesive coated substrates can be marketed in kit form with the customer-user being free to use graphic arts objects of his or her own choosing to make a unique collage puzzle. A further advantage is that different templates, i.e., templates having puzzle piece outlines different from that of template 2, can be used to add variation to the collage puzzle kits. Still another advantage is that in cutting out puzzle pieces, the user may cut along selected channels so that one or more of the finished puzzle pieces combine two or more of the outlines in the template, e.g., a single puzzle piece can be cut out that has the combined shapes of adjacent puzzle piece patterns 8X and 8Y shown in FIG. 1. Another important advantage is that two or more graphic arts objects can be mounted on the same substrate at different locations at the same time so as to form a single workpiece, and the template can be used to cut patterns of two or more collage puzzle pieces in that single workpiece, thereby reducing the number of times that the template has to be attached to and detached from workpieces to form puzzle pieces corresponding to all of the puzzle piece patterns defined in the template. Other advantages and modifications of the invention will be obvious to persons skilled in the art from the foregoing description.

We claim:

1. Method of manufacturing collage puzzle pieces comprising the steps of:

(a) providing a template having a plurality of channels in the form of line perforations, the channels being shaped and located so as to define patterns of a plurality of puzzle pieces, said channels being interrupted at selected locations so that at least one portion of each puzzle piece pattern is connected to at least one adjacent puzzle piece pattern;

(b) mounting at least one selected graphic art object on an adhesive-coated substrate so as to form a workpiece;

(c) assembling the workpiece and the template so that the template overlies the graphic art object;

(d) drawing a cutting blade along the full length of each channel defining a selected puzzle piece pattern so as to cut the underlying workpiece along lines conforming to the shape and location of said selected puzzle piece pattern, whereby to form a connected puzzle piece in said workpiece that is characterized by said selected puzzle piece pattern;

(e) separating the template from the workpiece;

(f) using a cutting blade to sever said connected puzzle piece from said workpiece; and (g) repeating steps (a) to (f) using the same template but workpieces that comprise different graphic arts objects, with each repetition of said step (d) involving a different selected puzzle piece pattern, whereby a plurality of different puzzle pieces are formed.

2. Method according to claim 1 wherein said substrate is in sheet form.

3. Method according to claim 1 further including the step of collecting said different puzzle pieces so as to form a complete set of pieces conforming in number and shape to the puzzle piece patterns in said template.

4. Method according to claim 3 wherein each of said puzzle piece patterns is shaped so that each of said different puzzle pieces is adapted to make an interlocking connection with at least one other of said puzzle pieces.

5. Method according to claim 3, further including the step of arranging said different puzzle pieces in the same relative positions as the corresponding patterns in said template, whereby to form a collage puzzle.

6. Method according to claim 1 wherein each of said puzzle piece patterns is shaped so that each of said different puzzle pieces is adapted to make an interlocking connection with at least one other of said puzzle pieces.

7. Method of manufacturing a collage puzzle comprising the steps of:

(a) providing a template having a plurality of through cuts shaped and arranged so as to define outlines of individual puzzle pieces interconnected together by webs;

(b) mounting at least one selected graphic art object on an adhesive-coated substrate so as to form a workpiece;

(c) assembling the workpiece and the template so that the template overlies the graphic art object;

(d) inserting a cutting blade into each of the through cuts defining a selected puzzle piece outline and drawing the cutting blade along the full length of said each through cut so as to cut the underlying workpiece along lines defining a selected puzzle piece conforming to said selected puzzle piece outline and at least one web connecting said selected puzzle piece to said workpiece;

(e) separating the template from the workpiece;

(f) cutting said at least one web in said workpiece with a cutting blade so as to separate said selected puzzle piece from said workpiece; and (g) repeating steps (a) to (f) using the same template but workpieces that comprise different graphic arts objects, with each repetition of said steps (b) to (d) involving a different selected puzzle piece outline, whereby a plurality of different puzzle pieces are formed; and (h) selecting one each of said different puzzle pieces so as to form a collage puzzle.

8. Method according to claim 7 wherein each of said puzzle piece patterns is shaped so that each of said different puzzle pieces is adapted to make an interlocking connection with at least one other of said puzzle pieces.

9. Method according to claim 7 wherein said substrate comprises a sheet of a low density foam plastic material with an adhesive coating, and said graphic arts objects are attached to said substrate by said adhesive coating.

10. Method according to claim 7 wherein said substrate has a thickness in the order of 0.050 inches.

11. Method according to claim 7 wherein said substrate has sufficient thickness to enable said puzzle pieces to interlock with one another.

12. Method according to claim 7 wherein said substrate is a magnetic material.

13. Method according to claim 7 wherein said substrate comprises a sheet of a low density plastic material with an adhesive coating, and said graphic arts objects are attached to said substrate by said adhesive coating.

14. Method according to claim 13 wherein said low density plastic material is a polyethylene or polystyrene foam.

15. Method according to claim 8 wherein said template is made of a transparent material.

16. Method according to claim 8 wherein said template is made of a translucent material.

17. Method according to claim 8 wherein said template has a plurality of registration holes to accommodates pins for holding said template in registration with said substrate.

18. Method according to claim 8 wherein at least a portion of said template is contacted by a portion of said adhesive coating, whereby said adhesive coating serves to hold said template against movement relative to said substrate.

19. Method of manufacturing a collage puzzle comprising the steps of:

(a) providing a template in sheet form having a plurality of channels in the form of line perforations, the channels being shaped and located so as to define a plurality of puzzle pieces patterns, said channels being interrupted at selected locations so that at least one portion of each puzzle piece pattern is connected to at least one adjacent puzzle piece pattern;

(b) mounting at least one selected graphic art object on an adhesive-coated substrate so as to form a workpiece;

(c) assembling the workpiece and the template so that the template overlies the graphic art object;

(d) drawing a cutting blade along the full length of each channel defining a selected puzzle piece pattern so as to cut the underlying workpiece along lines conforming to the shape and location of said selected puzzle piece pattern, whereby to form a connected puzzle piece in said workpiece;

(e) separating the template from the workpiece;

(f) using a cutting blade to sever said connected puzzle piece from said workpiece;

(g) repeating steps (a) to (f) using the same template but workpieces that comprise different graphic arts objects, with each repetition of said step (d) involving a different selected puzzle piece pattern, whereby a plurality of different puzzle pieces are formed; and (h) selecting one each of said different puzzle pieces so as to form a collage puzzle.

20. Method according to claim 19 wherein said substrate is made of a magnetic material.

* * * * *